US005496250A

United States Patent [19]

Fielder et al.

[11] Patent Number: 5,496,250

[45] Date of Patent: Mar. 5, 1996

[54] METHOD FOR FORMING TRAY TYPE CARTONS

[76] Inventors: Larry D. Fielder, 768 Summer Meadow Ct., Stone Mountain, Ga. 30087; Ronald L. Goelz, 704 Castilleja, Naperville, Ill. 60540

[21] Appl. No.: 231,927

[22] Filed: Apr. 25, 1994

[51] Int. Cl.[6] ..... B31B 1/46; B31B 3/60; B31B 1/74; B26F 1/00

[52] U.S. Cl. ..... 493/169; 493/342; 493/373; 493/337; 493/356; 53/453; 156/513

[58] Field of Search ..... 493/61, 62, 81, 493/82, 83, 123, 128, 130, 131, 132, 141, 143, 160, 167, 168, 169, 161, 162, 174, 175, 177, 373, 342, 331, 336, 337, 151; 53/242, 244, 245, 447, 453, 540, 559, 377.4; 156/513, 514

[56] References Cited

U.S. PATENT DOCUMENTS

| | | | |
|---|---|---|---|
| 1,534,569 | 4/1925 | Butterfield | 93/47 |
| 1,793,082 | 2/1931 | Goss | 493/337 |
| 2,004,604 | 6/1935 | Ford et al. | 93/47 |
| 3,357,322 | 12/1967 | Gill | 493/82 |
| 4,256,025 | 3/1981 | Goda et al. | 493/160 |
| 4,289,491 | 9/1981 | Collura | 493/169 |
| 4,299,590 | 11/1981 | Sasaki | 493/169 |
| 4,522,618 | 6/1985 | Stannard | 493/130 |
| 4,637,811 | 1/1987 | Fortney | 493/167 |
| 4,985,012 | 1/1991 | Marschke | 493/373 |

*Primary Examiner*—Bruce M. Kisliuk
*Assistant Examiner*—Christopher W. Day

[57] ABSTRACT

An improved method for forming tray, boat, tray, boat, and/or clamshell type, paperboard, cartons that have horizontal main wall panels and side wall panels, with corner flaps, joined to the main wall panels and extending therefrom and adhesively secured to each other. The cartons are formed from rolls or sheets of paperboard wherein the cutting, stripping, gluing, and forming operations are performed in a completely inline operation.

13 Claims, 3 Drawing Sheets

FORMING CHAMBER
FORMING CHAMBER
LS
CS
SG
FS
FSI
B1
C1
C
S

METHOD FOR FORMING TRAY TYPE CARTONS

BACKGROUND OF THE INVENTION

1. Field of the Invention

This invention relates to the production of folding cartons, and more particularly to an improved method for forming tray, boat, and/or clamshell type cartons from sheets of paperboard, wherein the cutting, stripping, gluing, and forming operations are all performed in a completely inline operation.

2. Description of the Background Art

A background art search directed to the subject matter of this invention conducted in the United States Patent and Trademark Office disclosed the following United States Letters Patent:

| | | | |
|---|---|---|---|
| 1,534,569 | 1,965,274 | 2,004,604 | 2,398,200 |
| 3,618,482 | 3,854,385 | 4,256,025 | 4,289,491 |
| 4,295,839 | 4,637,811 | 4,778,439 | 4,832,675 |
| 4,861,325 | | | |

None of the patents uncovered in the search discloses either a method or apparatus for producing tray type, paperboard, folding cartons wherein all of the cutting, stripping, gluing, and forming operations are performed in a completely inline operation.

SUMMARY OF THE INVENTION

It is a primary object of the invention to provide an improved method for manufacturing tray, boat, and/or clamshell type paperboard cartons, which method is more efficient than the methods currently being used for the production of these types of cartons. A more specific object of the invention is the provision of a method of making cartons of the type described wherein all of the the cutting, stripping, gluing, and forming operations are performed in a completely inline operation These and other objects of the invention will be apparent from an examination of the following description and drawings.

It will be understood that, for purposes of clarity, certain elements may have been omitted from certain views where they are believed to be illustrated to better advantage in other views.

DESCRIPTION OF THE PREFERRED EMBODIMENT

Figure 1:
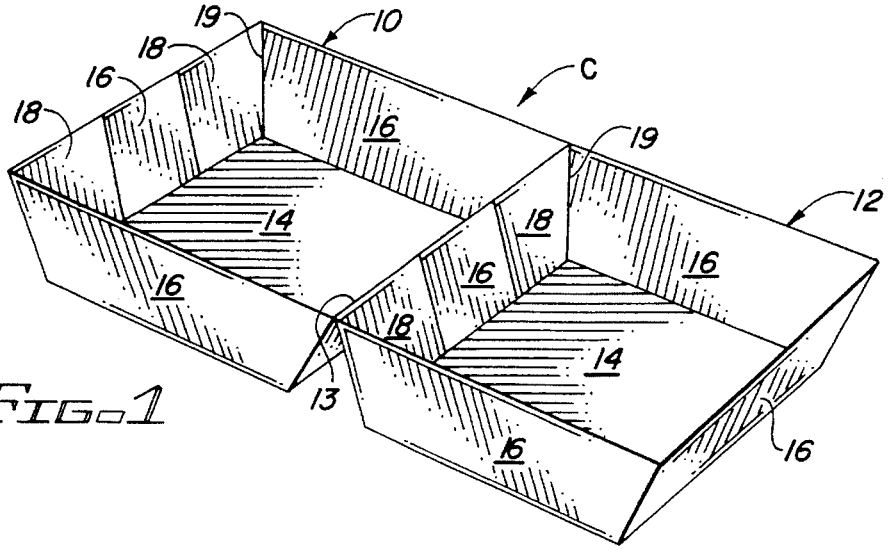
FIG. 1 is a fragmentary, isometric view of a clamshell type carton which can be formed by the method of the present invention illustrated in the other views.

Referring now to the drawings for a better understanding of the invention, it will be understood that the method of the present invention is particularly suitable for use in forming tray, boat, and/or clamshell cartons of the type illustrated in FIG. 1.

The carton indicated generally at C in FIG. 1 is a clamshell type carton that comprises generally similar tray body and cover members 10 an 12, respectively, which are hingedly attached to each other along a hinge line indicated at 13.

Each of the carton members includes a horizontal main wall panel 14 having a plurality of vertical side wall panels 16 foldably joined to side edges of the main panel along fold lines 19 and extending away from the main panel to form a hollow structure.

The side wall panels of each member may be connected to adjacent side wall panels by corner flaps 18, each of which is foldably joined to one side wall panel and adhesively secured to an adjacent side wall panel in overlapped relation. The exact details of the carton structure is not important, so long as the carton is a tray or clamshell type carton having at least one horizontal wall with vertical side walls with corner flaps connecting adjacent side walls to each other.

The reason that the carton structure details are not essential to the invention is that the invention relates primarily to the method used to form the cartons. What is new is the concept of performing all of the steps required to form clamshell and/or other tray type cartons in a completely inline operation.

In the present invention the cartons are produced from paperboard, which can be in the form of either separate sheets, as described in connection with the first embodiment, or in web or roll form, as described in connection with the second embodiment.

FIGS. 2 and 3A–3C are schematic diagrams that illustrate the steps of forming cartons in accordance with one embodiment of the the present invention.

Figures 2, 3A, 3B, 3C, 5:
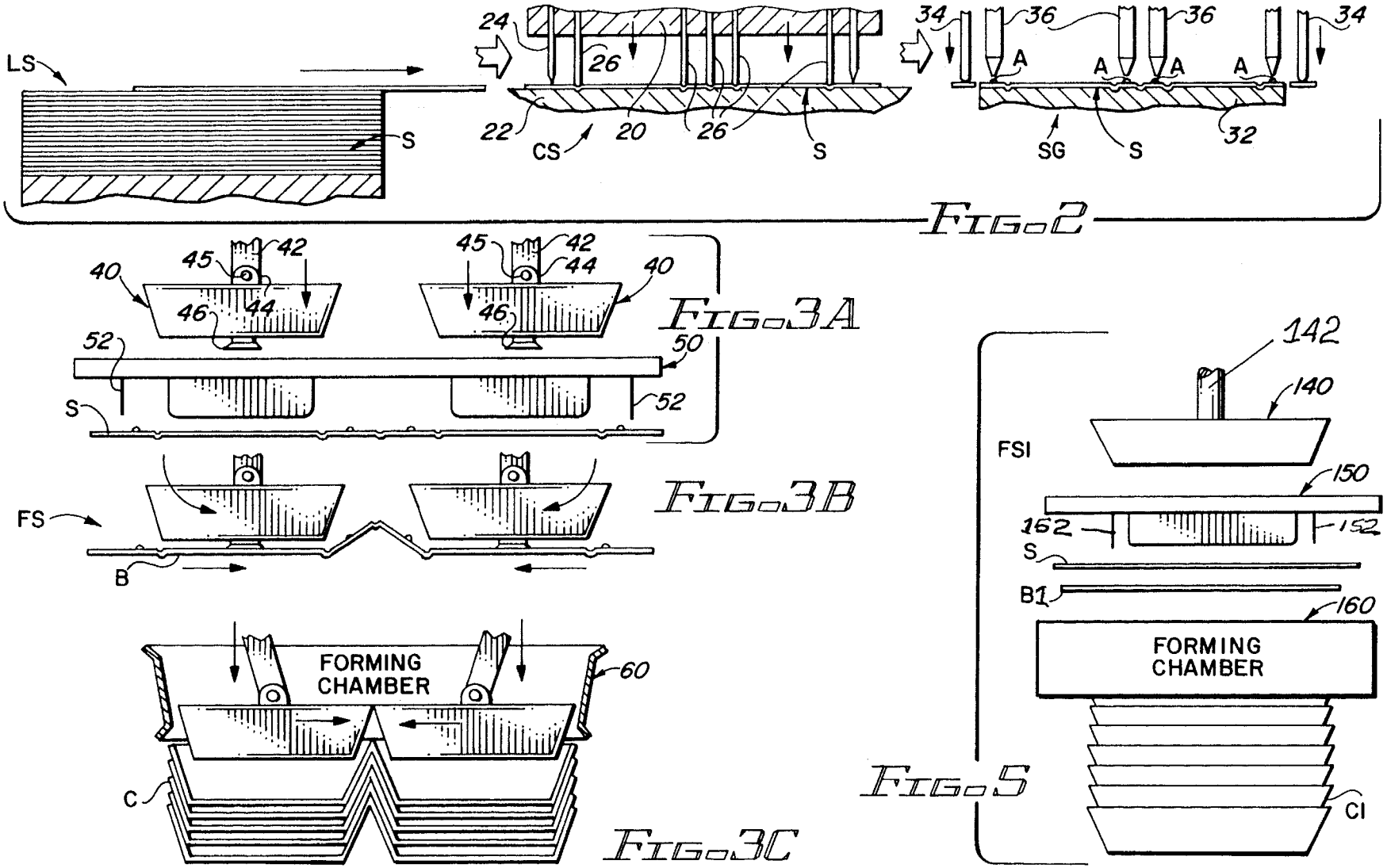
FIG. 2 is a schematic diagram illustrating various steps of one embodiment of the method of the present invention.
FIGS. 3A, 3B, and 3C are other schematic diagrams illustrating additional steps of the method of the present invention.
FIG. 5 is a view similar to those of FIGS. 3A–3C, but is shown with a slightly different style of carton being formed.

Referring first to FIG. 2, it will be seen that sheets of paperboard, indicated at S, are stacked one atop the other at the first or loading station LS. The sheets S may be preprinted, if desired, or may be unprinted.

Sheets S are then transferred, one at a time from the top of the stack, to the cutting and scoring station CS.

At the cutting and scoring station each sheet is positioned, between upper male and lower female cutting and scoring dies 22 and 24, respectively, where cutting knives 26 and scoring rules 24 move downwardly to cut and score the sheet S and thereby form a plurality of interconnected blanks B, each of which is used to form an individual carton C.

After each sheet S has been cut and scored to form a plurality of interconnected blanks B, the sheet is transferred to the stripping and gluing station SG, where the sheet is positioned over another female die or bed 32.

At the stripping and gluing station stripper pins 34 move downwardly through the blanks to strip all of the waste paperboard material from the blanks of the sheet. At the same time that the stripping operation occurs, adhesive applicator nozzles 36 apply either conventional or hot melt adhesive A to the appropriate areas of each of the blanks B.

After the stripping and gluing operations have been completed, the sheet S passes to forming station FS, shown in FIGS. 3A–3C.

Figure 4:
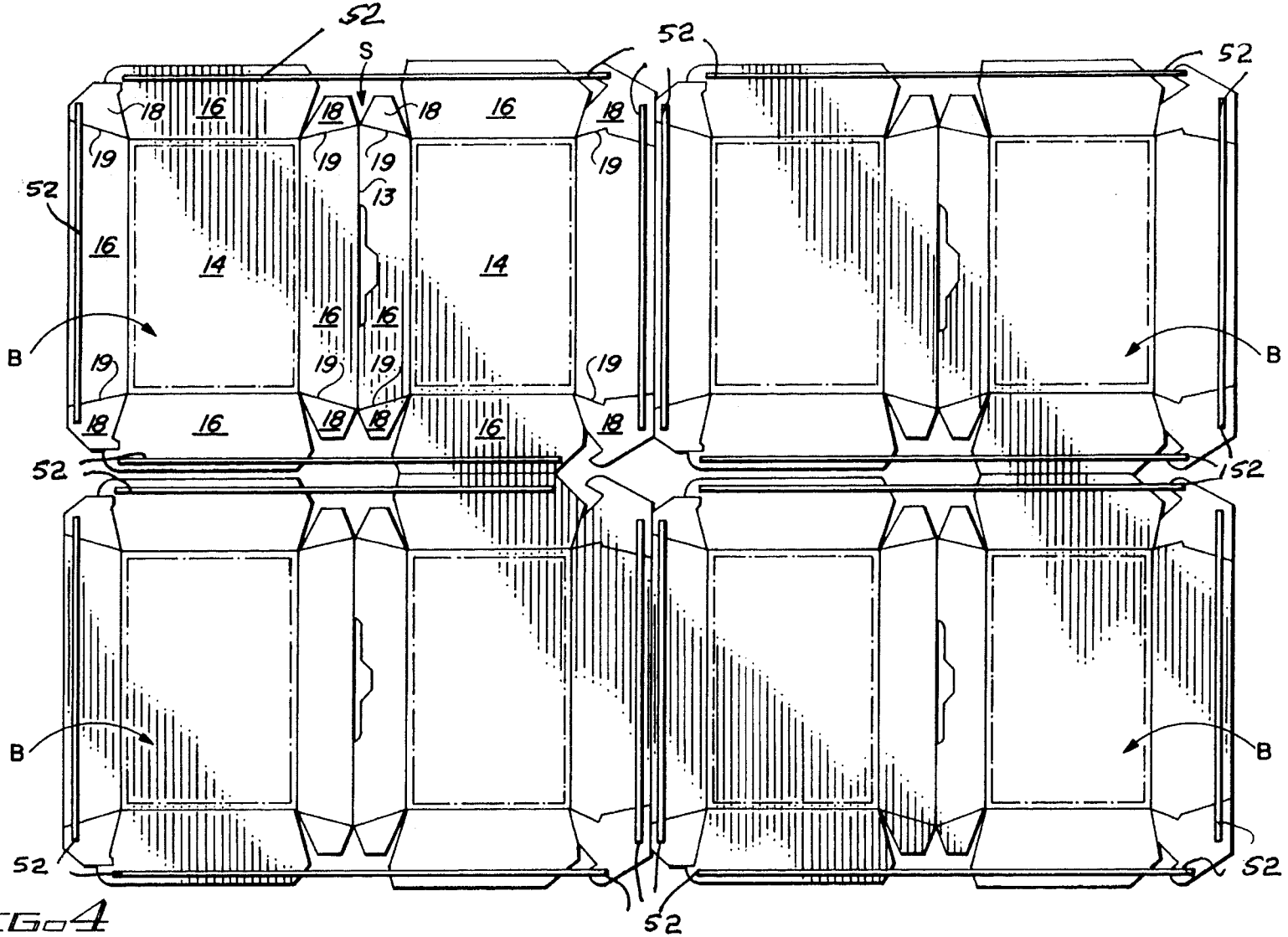
FIG. 4 is a plan view of the structure illustrated in FIG. 3A.

At the forming station FS, over each blank B of the sheet S are positioned a generally rectangular, hollow, blanker fixtures 50 which includes a plurality of downwardly extending blades, as best seen in FIGS. 3A and 4. The purpose of the blanker fixtures is to separate the individual blanks B of the sheet S from each other.

As best seen in FIGS. 3A–3C, a pair of forming heads 40 are positioned above each blanker fixture 50. As the blanker fixtures are hollow, the forming heads can move downwardly through the blanker fixtures to form the cartons C, as hereinafter described.

After each sheet S is transferred to the forming station FS, the first operation that occurs is the downward movement of the blanker fixtures 50 to separate the blanks B from the sheet S.

When the method of the present invention is used to form a clamshell type carton, that has separate tray and cover members, a pair of forming heads 40 are required. Each forming head 40 is supported by an arm 42, which may be attached to a collar or clevis 44 of the head by a pin 45. Also, each forming head 40 may be provided with a vacuum cup 46, which may retract into the head.

After the individual blanks B have been separated from each other, the actual carton forming operation occurs. When a pair of heads 40 are moved downwardly to engage a blank B, the vacuum cups engage the main or horizontal panels 14 of each blank B and move the horizontal panels toward each other, from the position illustrated in FIG. 3A to the position illustrated in FIG. 3B.

As the main panels of the blank are moved toward each other, the adjacent side wall panels 16 are also moved toward each other, so that when the heads move all the way down to their lowermost position, the blank B is driven through the hollow, rectangular, forming chamber 60 to form the cartons. After the cartons are so formed, they are pressed into a stack of previously formed cartons C which hold the cartons in place while the adhesive is setting.

In FIG. 5, which is similar to the views of FIGS. 3A–3C, there is illustrated a forming head arrangement for use with a single tray type carton C1 without a cover and with a structure that is the similar to the tray member of the carton C illustrated in FIG. 1. Portions of the structure illustrated in FIG. 5 which correspond to structures of FIGS. 3A–3B are identified by related numerals.

In the embodiment of FIG. 5, there is a single forming head 140, carried by an arm 142, and operable to move downwardly, through a blanker fixture 150, to force a blank B1 through a forming chamber frame 160 to form a carton C1 and press it down into a stack of previously formed cartons C1.

Also, in the case of this embodiment the steps of cutting, scoring, stripping, gluing, and forming are all accomplished in an inline operation.

Figure 6:
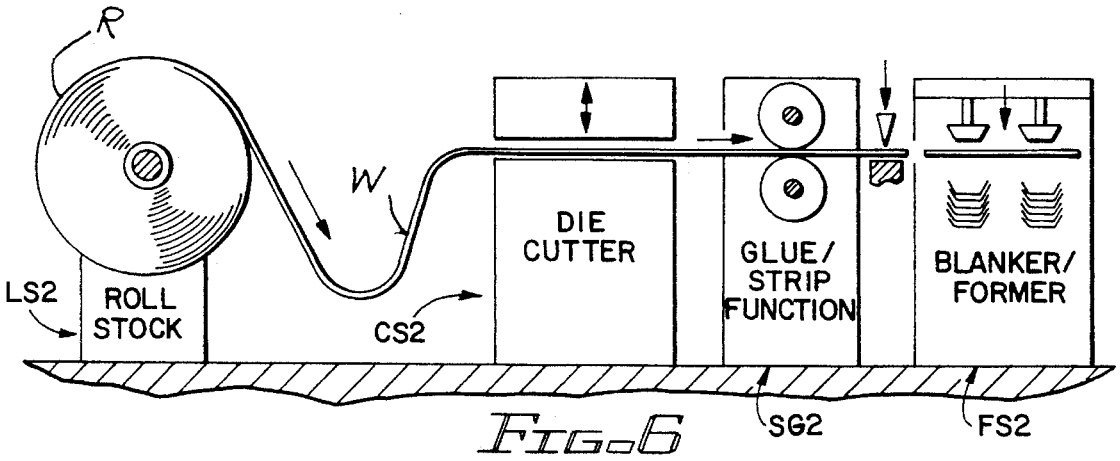
FIG. 6 is a view similar to that of FIG. 2, but illustrating a modified form of the invention.
Figure 7:
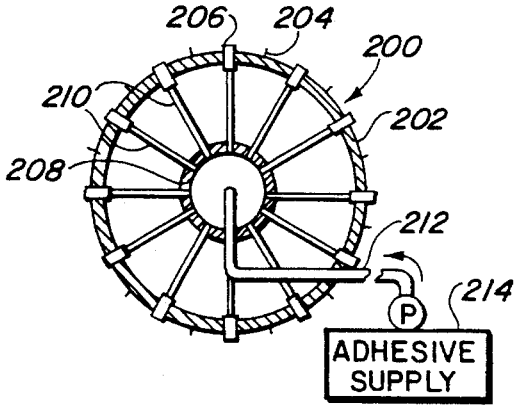
FIG. 7 is a fragmentary side elevational view of an adhesive applicator of the type illustrated in FIG. 6.

Referring now to FIGS. 6 and 7, it will be seen that a slightly modified form of the invention is illustrated. In this embodiment, the paperboard used to form the cartons C1 is brought to the loading station LS2 in the form of a roll R from which a web W passes first to the cutting and scoring station CS2.

The cutting and scoring operations are performed at station CS2 in the same manner as they are at the cutting and scoring station CS of the first embodiment, illustrated in FIG. 2.

From the cutting and scoring station CS2 the paperboard web W passes to the stripping and gluing station SG2, where the waste paperboard is stripped away from the paperboard blanks and adhesive A is applied to the appropriate surface areas of the blanks B. Although the end results of the stripping and gluing operations is the same, the operations are performed by different equipment in a different way from that of the first embodiment.

As best seen in FIG. 7, the stripping and gluing is done by a drum type device that includes a cylinder indicated generally at 200. The outer wall 202 of the cylinder has projecting outwardly therefrom a plurality of stripper pins 204 and adhesive applicator nozzles 206.

Adhesive A is transferred from an adhesive supply tank 214 through a line 212 to the cylinder hollow inner core or axle 208 and from there to the nozzles 206 through a plurality of tubes 210. through tubes 210.

As the paperboard web W leaves the stripping and gluing station SG2, the sheets S, which have been held together by nicks, are separated from each other and are transferred, one at a time to the forming station FS2. The equipment and method used at station FS2 are exactly the same as described in connection with the first embodiment and illustrated in FIGS. 3A-4.

Figure 8:
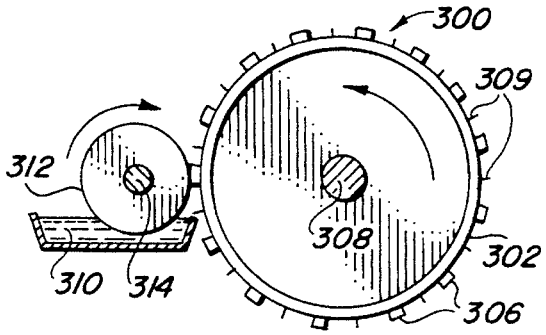
FIG. 8 is a view similar to that of FIG. 7, but illustrating a slightly different form of adhesive applicator.

Now referring to FIG. 8 of the drawings it will be seen that a slightly different form of stripper gluer device is used. In this embodiment the device again is a cylinder indicated generally at 300 having an outer wall 302 carrying a plurality of stripper pins 309 and adhesive applicator pads 306.

Cylinder 300 is disposed for rotation about an inner core or axle 308 and is positioned adjacent an adhesive supply tank 310. Adhesive A is transferred from tank 310 to the applicator pads 306 by means of a transfer cylinder positioned for rotation within tank 310 and for engagement with the applicator pads of cylinder 300.

Thus, it will be understood that each embodiment of the invention provides a vastly improved method, over the methods currently employed in the packaging field, for forming clamshell or tray type cartons in a completely inline operation.

What is claimed is:

1. A method of forming, from paperboard, on equipment in a completely inline operation, a plurality of clamshell type cartons, each of said cartons including a pair of hingedly interconnected body and cover members, and each of said members including a horizontal main wall panel and a plurality of side wall panels, with corner flaps, extending therefrom and adhesively secured to each other, said method comprising the steps of:

(a) positioning said paperboard at a loading station of said equipment;

(b) moving said paperboard from said loading station, to a cutting and scoring station;

(c) die cutting and scoring said paperboard, at said cutting and scoring station, to provide a plurality of interconnected carton blanks;

(d) moving said plurality of interconnected blanks from said cutting and scoring station to a combination stripping and gluing station:

(e) simultaneously stripping waste material from said plurality of interconnected blanks and applying adhesive to pertinent areas of said blanks at said stripping and gluing station;

(f) moving said plurality of interconnected blanks from said stripping and gluing station to a forming station;

(g) at said forming station, separating said plurality of interconnected blanks from each other and moving said horizontal main panels of the members of each of said pairs toward each other; and (h) forming cartons from said separated blanks by applying forming heads to said separated blanks to engage said separated blanks and push them through forming chambers and into cavities of previously formed and stacked cartons, which cavities hold said cartons until previously applied adhesive has set.

2. A method according to claim 1 wherein said paperboard is initially in the form of separate sheets and wherein said sheets are arranged in a vertical stack at said loading station.

3. A method according to claim 1, wherein said paperboard is initially in the form of a roll.

4. A method according to claim 1, wherein said horizontal main wall panels are moved by separate vacuum cups carried by said forming heads.

5. A method of forming, from paperboard, on equipment in a completely inline operation, a plurality of tray type cartons, each of said cartons including a body member including a horizontal main wall panel and a plurality of side wall panels, with corner flaps, extending therefrom and adhesively secured to each other, said method comprising the steps of:

(a) positioning said paperboard at a loading station of said equipment;

(b) moving said paperboard from said loading station, to a cutting and scoring station;

(c) die cutting and scoring said paperboard, at said cutting and scoring station, to provide a plurality of interconnected carton blanks;

(d) moving said plurality of interconnected blanks from said cutting and scoring station to a combination stripping and gluing station:

(e) simultaneously stripping waste material from said plurality of interconnected blanks and applying adhesive to pertinent areas of said blanks at said stripping and gluing station;

(f) moving said plurality of interconnected blanks from said stripping and gluing station to a forming station, and, at said forming station, separating said plurality of interconnected blanks from each other; and (g) forming cartons from said separated blanks by applying forming heads to said separated blanks to engage said separated blanks and push them through forming chambers and into cavities of previously formed and stacked cartons, which cavities and hold said cartons until previously applied adhesive has set.

6. A method according to claim 5, wherein said paperboard is in the form of separate sheets and wherein said sheets are arranged in a vertical stack at said loading station.

7. A method according to claim 5, wherein said paperboard is initially in the form of a roll.

8. A method according to claim 5, wherein each of said cartons also includes a cover member hingedly attached to said body member, and including a horizontal main wall panel and a plurality of side wall panels, with corner flaps, extending therefrom and adhesively secured to each other, and including the step of moving said horizontal main panels of said body and cover members of each of each of said blanks toward each other at said forming station before said blanks are pushed through said forming chambers.

9. A method according to claim 8, wherein said horizontal main wall panels are moved by separate vacuum cups carried by said forming heads.

10. A method of forming, from paperboard sheets, on equipment in a completely inline operation, a plurality of clamshell type cartons, each of said cartons including a pair of hingedly interconnected body and cover members, and each of said members including a horizontal main wall panel and a plurality of side wall panels, with corner flaps, extending therefrom and adhesively secured to each other, said method comprising the steps of:

(a) positioning said paperboard sheets in a vertical stack at a loading station of said equipment;

(b) moving said sheets from said loading station, to a cutting and scoring station;

(c) die cutting and scoring said sheets, at said cutting and scoring station, to provide a plurality of interconnected carton blanks;

(d) moving said plurality of interconnected blanks from said cutting And scoring station to a combination stripping and gluing station:

(e) simultaneously stripping waste material from said plurality of interconnected blanks and applying adhesive to pertinent areas of said blanks at said stripping and gluing station;

(f) moving said plurality of interconnected blanks from said stripping and gluing station to a forming station;

(g) at said forming station, separating said plurality of interconnected blanks from each other and moving said horizontal main panels of the members of each of said pairs toward each other; and (h) forming cartons from said separated blanks by applying forming heads to said separated blanks to engage said separated blanks and push them through forming chambers and into cavities of previously formed and stacked cartons, which cavities hold said cartons until previously applied adhesive has set.

11. A method according to claim 10, wherein said horizontal main wall panels are moved by separate vacuum cups carried by said forming heads.

12. A method of forming, from a paperboard roll, on equipment in a completely inline operation, a plurality of clamshell type cartons, each of said cartons including a pair of hingedly interconnected body and cover members, and each of said members including a horizontal main wall panel and a plurality of side wall panels, with corner flaps, extending therefrom and adhesively secured to each other, said method comprising the steps of:

(a) positioning said paperboard roll at a loading station of said equipment;

(b) moving said paperboard from said roll at said loading station, to a cutting and scoring station;

(c) die cutting and scoring said paperboard, at said cutting and scoring station, to provide a plurality of interconnected carton blanks;

(d) moving said plurality of interconnected blanks from said cutting and scoring station to a combination stripping and gluing station:

(e) simultaneously stripping waste material from said plurality of interconnected blanks and applying adhesive to pertinent areas of said blanks at said stripping and gluing station;

(f) moving said plurality of interconnected blanks from said stripping and gluing station to a forming station;

(g) at said forming station, separating said plurality of interconnected blanks from each other and moving said horizontal main panels of the members of each of said pairs toward each other; and (h) forming cartons from said separated blanks by applying forming heads to said separated blanks to engage said separated blanks and push them through forming chambers and into cavities of previously formed and stacked cartons, which cavities hold said cartons until previously applied adhesive has set.

13. A method according to claim 12, wherein said horizontal main wall panels are moved by separate vacuum cups carried by said forming heads.

* * * * *